United States Patent [19]

Toeppen

[11] 4,398,645

[45] Aug. 16, 1983

[54] CLOSURE FOR PRESSURIZED CONTAINERS

[76] Inventor: Thurston Toeppen, Lois La., R.D. 3, Poughkeepsie, N.Y. 12603

[21] Appl. No.: 278,971

[22] Filed: Jun. 29, 1981

[51] Int. Cl.[3] ..... B65D 53/00

[52] U.S. Cl. ..... 215/252; 215/344; 215/DIG. 1

[58] Field of Search ..... 215/DIG. 1, 344, 252, 215/329

[56] References Cited

U.S. PATENT DOCUMENTS

| | | | |
|---|---|---|---|
| 3,055,526 | 9/1962 | Plunkett | 215/329 |
| 3,203,571 | 8/1965 | Plunkett | 215/344 |
| 3,286,866 | 11/1966 | McIntosh | 215/DIG. 1 |
| 3,583,591 | 6/1971 | Hayashida | 215/DIG. 1 |
| 3,802,590 | 4/1974 | Culver | 215/DIG. 1 |
| 4,241,842 | 12/1980 | Toeppen | 215/252 |
| 4,294,370 | 10/1981 | Toeppen | 215/329 |

*Primary Examiner*—Donald F. Norton

*Attorney, Agent, or Firm*—Kane, Dalsimer, Kane, Sullivan & Kurucz

[57] ABSTRACT

A screw-type linerless closure molded of resilient plastic is provided with a combination of sealing structures directed toward the particular characteristics of glass containers as used for pressurized beverages, though it may also be used for other containers. Novel means for accomodating large dimensional tolerances and special surface conditions are used, along with prior art constructions, to secure improved sealing under a wide variety of conditions.

9 Claims, 4 Drawing Figures

CLOSURE FOR PRESSURIZED CONTAINERS

BACKGROUND OF THE INVENTION

The present invention is directed to a linerless, threaded, molded plastic closure, particularly intended for use with glass bottles containing pressurized liquids, but also suitable for use with other types of containers and for non-pressurized applications.

The carbonated-beverage industry produces large amounts of a bulky product in which the container package must meet severe performance requirements while representing a relatively large percentage of the total product cost. Under these conditions, the need for a container closure which is highly efficient and at the same time economical is evident.

In addition to the primary need for a closure which will provide for the retention of high gas pressures in combination with low installed cost, there are numerous secondary needs, some of which are nearly as important. These may be subdivided among those relating to manufacture, distribution, and use of the product, as described below.

During manufacture of the product it is desirable to be able to use closures which will operate with typical industry-standardized bottle-top finishes, without requiring the provision of unusual or proprietary bottle constructions. This facilitates the use of existing equipment, and the re-use of bottles to prevent littering. It is also desirable to be able to use standard bottling equipment with a minimum of special tools, processes and maintenance, and under circumstances which provide favorable sanitary conditions.

During distribution, the closure must be able to withstand repeated handlings, with their associated impacts and abrasions. Storage also presents particular problems, since the product must maintain a high percentage of the original gas pressure over a period of several weeks or months. Many of the storage problems are related to temperature conditions, which may range from near-freezing during refrigeration, or during winter storage, to high temperatures in some warehouses in hot areas. However, some are related to less obvious storage conditions, as when several open-top cases of the bottled product are stacked, so that the entire weight of the stack may rest on a few of the closures and containers of the bottom case.

In customer use, it is desirable to have the closure readily removable by a person of less than average strength, without the use of a special uncapping tool. It should have effective means for assuring the user that the bottle has not previously been opened. It should be relatively free from any tendency to blow off prematurely during unscrewing of the closure. It should be resealable after the initial opening, so that any of the product not used immediately can be conserved for future use with minimum loss of pressure. Finally, it should be reclaimable, so that, where conditions of use permit, the used closures can be reprocessed and the material re-used, in order to conserve material and prevent littering.

In the past, closures for pressurized applications have usually been made of metal with a resilient cork or plastic liner. The metal closures have been acceptable from the production and distribution standpoints, but have had shortcomings from the viewpoint of the user. Those which do not require a special tool for removal are likely to require relatively strong fingers, and may tend to cut the fingers. If effective tamper-indicating means are provided, it is usually in the form of a retained metal ring around the neck which deters re-use of the bottle and/or recycling of the material. Resealability is impracticable with non-threaded metal closures, and is not always reliable with threaded ones on account of the irregular thread friction often encountered when they are used with glass bottles. Finally, reclaimability of the closure material is limited because of the combination of metal and sealing material.

Linerless, threaded, molded plastic closures are an attractive alternative to the metal-based closures, since they are potentially free of the user-related limitations cited above. However, they have not yet been able to meet adequately some of the distribution requirements mentioned, especially those involving pressure-retention and top-loading during extended storage. The problems in these areas are particularly evident when using such closures in combination with glass bottles, which have much larger variations in dimensional accuracy and surface finish than the corresponding plastic or metal containers. For this reason, a closure which is acceptable for use with the latter may not be satisfactory for glass.

It is therefore clear that a need exists for a plastic closure which is particularly adapted to the special conditions associated with glass bottles as widely used in the carbonated-beverage industry, and which will provide a combination of features enabling it to meet, in an acceptable degree, all of the specific needs of this application. Such a closure should, at the same time, be suitable for many less-demanding applications.

SUMMARY OF THE INVENTION

The invention described herein comprises a screw-type, linerless closure for use with threaded containers, molded from polyethylene, polypropylene, or other resilient plastic materials suited to the particular application. The use of resilient plastic makes it inherently resistant to shock and abrasion, and as a one-piece molded closure it can be economically fabricated and conveniently recycled. Specific design features as described below are provided to secure high sealing efficiency over a wide range of storage and handling conditions, and to assure safety and convenience for the user.

In order to accommodate the wide range of dimensional tolerances and surface finishes associated with glass containers, the subject closure employs sealing elements which bear on the top and inside-corner surfaces of the container outlet. A conical or contoured sealing flange, depending from the underside of the crown, and generally similar to some of those shown in Plunkett U.S. Pat. No. 3,055,526, is deflected into a shape which adjusts itself to fit those surfaces. Novel supplementary sealing elements cooperate with the flange member to perform specialized functions in the overall sealing system, as described below in detail.

The structure of the internal thread of the closure may also contribute to the efficiency of the sealing action, by utilizing the compensated-pitch principle described in my pending U.S. patent application entitled "Thread Construction for Plastic Closures", Ser. No. 133,536, filed Mar. 24, 1980, now U.S. Pat. No. 4,294,370.

In order to meet the need for means to assure the user that the container has not previously been opened, the lower edge of the closure may incorporate the tamper-indicating construction described in my U.S. Pat. No. 4,241,842 entitled "Tamper-indicating Construction for Plastic Closures".

An object of the invention is to provide an improved closure for use on a variety of threaded containers.

Another object of the invention is to provide an improved linerless, molded plastic closure which is suitable for use with containers holding pressurized liquids, and which is adapted to the special characteristics of glass containers.

DESCRIPTION OF THE PREFERRED EMBODIMENTS

Figure 1:
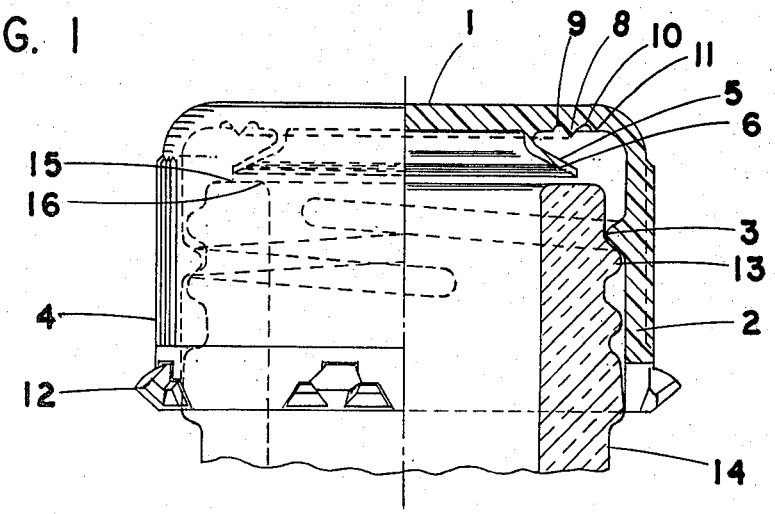
FIG. 1 is an enlarged side view, partially sectioned on the central plane of a closure according to the invention, showing the closure partially installed on a container but prior to sealing contact.

As shown in FIG. 1, the invention is embodied in a molded plastic, screw-type closure made of polyethylene, polypropylene, or a similar resilient plastic. The basic structure of the closure comprises a circular crown 1, a concentric cylindrical sidewall or skirt 2 which is integral with the crown, an internal screw thread 3 for mating with a container thread 13, and external knurls or flutes 4 by which the closure may be gripped to rotate it on to or off of the container thread.

Depending from crown 1 and concentric with it is a sealing flange 5, in the form of a truncated cone which may be provided with a short cylindrical base portion. If desirable, in order to permit more efficient extraction from the mold, seal 5 may be initially molded with a narrower cone angle, subsequently being re-formed to approximately the contour shown in FIG. 1 by the application of controlled heat and pressure in the manner described in the aforesaid Plunkett U.S. Pat. No. 3,055,526.

Molded into the under surface of seal 5 is a series of small concentric grooves 6. As shown enlarged in FIG. 3, these are separated by sharp-edged ridges 7 which supplement the operation of seal 5 in a manner to be described below. In order to avoid any interference with the fit of seal 5 as a whole, ridges 7 do not project beyond the adjacent sealing surface.

Also depending from crown 1, and concentric with it, is a sealing ridge 8, the diameter of which is substantially equal to the mean diameter of container top surface 15. Immediately inside and outside of the ridge are two grooves 9, 10. The crest of ridge 8 projects below the adjacent plane of the undersurface 11 of crown 1, and grooves 9, 10 are recessed into the body of crown 1, so that the volume of ridge 8 below plane 11 will be substantially equal to the combined volume of grooves 9, 10 above the plane. The crest of ridge 8 is substantially sharp as molded, whereas the contours of grooves 9, 10 are preferably rounded, for reasons which will be shown.

It is contemplated that thread 3 will incorporate the compensated-pitch principle described in my pending application Ser. No. 133,536, previously cited, in order to more effectively equalize thread loading and sealing pressure around the circumference of the closure.

The complete closure may also incorporate the tamper-indicating elements 12 described in my U.S. Pat. No. 4,241,842, in order to indicate when the seal of the closure may have been broken or the contents of the container disturbed.

Figure 2:
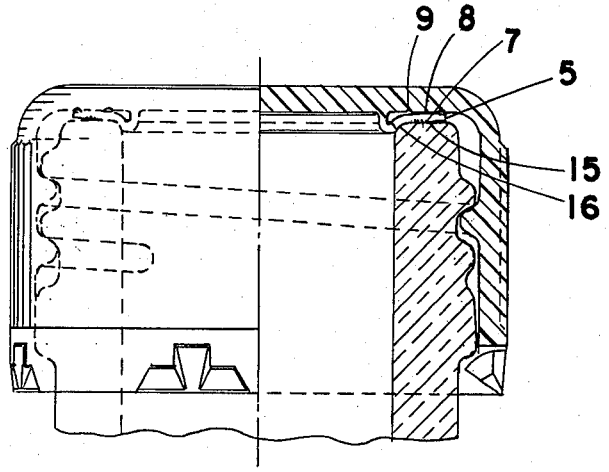
FIG. 2 is a similar sectional side view, the same as FIG. 1 except that the closure has been screwed down firmly onto the container so that the seals are fully deflected and the threads fully loaded.

As the closure is screwed on to the container, the undersurface of seal 5 is drawn tightly over inner container lip 16 before being set in its final position by the localized pressure of sealing ridge 8, as shown in FIG. 2. This draping action creates a close fit between seal 5 and inner lip 16, regardless of minor irregularities in the contour of the lip. This fit then operates to reduce gradually the internal gas pressure as it approaches the main sealing zone directly beneath ridge 8. By this means the local pressure drop across the final sealing zone itself is reduced to a minimum, further reducing the leakage rate.

During the final stage of tightening the closure the sharp edge of ridge 8 applies the axial closing force developed by the screw threads to a narrow zone on the upper surface of seal 5, and through it to multiple ridges 7 and to container top surface 15. At the same time, the axial force deflects all, or nearly all, of the material of ridge 8 into grooves 9, 10 as provided for by the designed volumes of ridge 8 and grooves 9, 10 and in accordance with the resilience of the molding material used.

Figure 3:
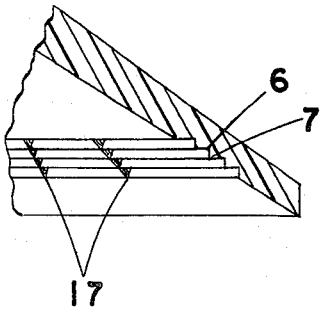
FIG. 3 is a more detailed view of the lower part of the sealing cone of FIG. 1.

Although surface 15 is normally made to be as smooth as glass technology permits, it typically possesses more small asperities and larger irregularities than a molded plastic surface. The small multiple ridges 7, each of which has one-third or less of the volume of ridge 8, are designed to absorb and to fill in the smallest of these asperities. Because the size and shape of inner lip 16 may vary from one lot of containers to another, and because the stretching of seal 5 over lip 16 may affect the final position of ridges 7 with respect to ridge 8, it is desirable to provide several concentric ridges 7, as shown in FIG. 3, so that one or two of them are sure to be directly underneath ridge 8 and will therefore be deformed into intimate contact with surface 15. It may also be desirable to mold a series of short ridges 17 perpendicular to ridges 7, and of the same height, in order to divide the grooves 6 into compartments as shown in FIG. 3. This will minimize leakage in case surfaces 15 and 16 should be even more irregular than normal, or if re-forming of seal 5 should introduce any irregularity into the concentricity of ridges 7.

The primary axial sealing pressure is applied through ridge 8, which is designed to be pliable enough to accommodate itself to the larger irregularities of top surface 15, deforming into portions of grooves 9 and 10 are required for this purpose. Grooves 9 and 10 have rounded cross-sections to minimize the development of notch stresses in that portion of crown 1, when under load from high gas pressures.

Grooves 9 and 10 also operate to enable the structure to better resist the effects of abnormal top-load pressures, which may be encountered when open-top cases are stacked several units high. If no relief were provided under such conditions, ridge 8 might be deformed so severely as to prevent adequate recovery after removal of the excess load, thereby permitting greater subsequent leakage. However, the construction as disclosed herein allows ridge 8 to deform into the space of grooves 9 and 10 until the excess load is shared by plane surface 11. Consequently, ridge 8 is less likely to be stressed beyond its compressive limit. It will then retain sufficient resilience to restore much, if not all, of its sealing efficiency after removal of the excess load.

Figure 4:
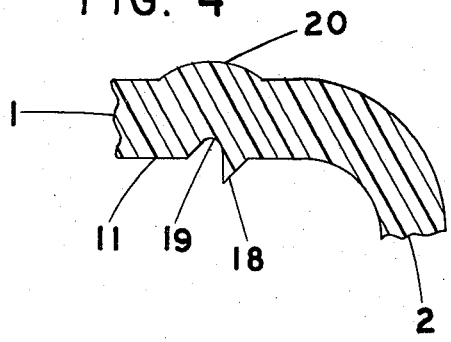
FIG. 4 is a partial sectional view of an upper portion of FIG. 1, showing an alternative design for the sealing ridge.

As an alternative to the symmetrical central ridge 8 and two adjoining grooves 9 and 10, an asymmetrical combination of ridge 18 and single groove 19 may be employed as shown in FIG. 4. Alternatively, the groove may be placed outside the ridge. This construction would be preferable in situations where top surface 15 is relatively narrow, as is usually the case with plastic containers. Since groove 19 is larger when the construction of FIG. 4 is used, it may then be desirable to provide extra material for crown 1 in the form of a reinforcing bead 20 directly above the groove. Such reinforcement may also be provided for grooves 9 and 10 if desired.

What is claimed is:

1. A closure device molded of resilient material, in combination with a container having an external screw thread about an opening and a rim perpendicular to said thread, comprising: a circular crown disc, a cylindrical sidewall or skirt depending from said crown disc and perpendicular to it, an internal screw thread within said sidewall to mate with said external screw thread, and multiple sealing means integral with the inside surface of said crown disc for cooperation with the upper rim and adjacent inside rim of the opening of said container, said multiple sealing means comprising:

a first sealing means in the form of a circular ridge dependent from said crown disc and having a diameter substantially equal to the mean diameter of said upper rim, said ridge having at least one concentric groove immediately adjacent thereto;

a second sealing means in the form of an outwardly flaring frusto-conical flexible flange supported by a concentric attachment to said crown disc and having an outer rim diameter substantially larger than the diameter of said first sealing means, said flange being engageable by said circular ridge to move said flange into intimate contact with a portion of said rim axially opposed to said ridge.

2. A closure device molded of resilient material, for use with a container having an external screw thread about an opening and a rim perpendicular to said thread, comprising: a circular crown disc, a cylindrical sidewall or skirt depending from said crown disc and perpendicular to it, an internal screw thread within said sidewall to mate with said external screw thread, and multiple sealing means integral with the inside surface of said crown disc for cooperation with the upper rim and adjacent inside rim of the opening of said container, said multiple sealing means comprising:

a first sealing means in the form of a circular ridge dependent from said crown disc and having a diameter substantially equal to the mean diameter of said upper rim;

a second sealing means in the form of an outwardly-flaring frusto-conical flexible flange supported by a concentric attachment to said crown disc and having an outer rim diameter substantially larger than the diameter of said first sealing means, said flange being engageable by said circular ridge to move said flange into intimate contact with a portion of said rim axially opposed to said ridge;

said first sealing means consisting of said circular ridge and a pair of circular grooves directly inside and outside of it, the combined volume of said grooves above the adjacent lower surface of said crown disc being sufficient to accommodate the material of said ridge upon deflection of the ridge into said grooves, said ridge volume being so related to the resilience of said material that when subjected to a normal axial working load said ridge will be substantially or entirely deflected into said grooves.

3. A closure device as in claim 2, incorporating a third sealing means in the form of at least one sharp-edged circular ridge recessed into the lower surface of said flange with its crest not projecting beyond said surface, and having a diameter after installation substantially equal to said first sealing means, said ridge or ridges each having an effective volume not greater than one-third that of said first sealing means.

4. A closure device as in claim 3, in which said third sealing means consists of at least two of said ridges transversely connected by at least two radial ridges of the same dimensions, equally spaced around their circumference, to form isolated sealing compartments.

5. A closure device as in claim 3, in combination with said container, in which the initial axial pitch of said internal screw thread is shorter than the initial axial pitch of said external screw thread, by an amount proportional to the difference in the effective elasticities of their respective component materials and to the axial pitch of said external thread.

6. A closure device as in claim 3, in combination with said container, in which the lower edge of said cylindrical sidewall or skirt incorporates one or more indicating portions for interacting with an annular shoulder below said external screw thread of said container, said indicating portion having an initial position outside of the cylindrical surface of said skirt and a second position of said indicating portion inside the cylindrical surface of said skirt, said indicating portion being movable radially of said skirt from said initial position to said second position, a tear zone of said device, a second shoulder on said indicating portion, whereby when said indicating portion is in the second position and when said second shoulder abuts said annular shoulder, axial movement of said skirt with respect to said container causes said indicating portion to separate from the skirt at said tear zone.

7. A closure device as in claim 2 in combination with said container, in which the initial axial pitch of said internal screw thread is shorter than the initial axial pitch of said external screw thread, by an amount proportional to the difference in the effective elasticities of their respective component materials and to the axial pitch of said external thread.

8. A closure device as in claim 2 in combination with said container, in which the lower edge of said cylindrical sidewall or skirt incorporates one or more indicating portions for interacting with an annular shoulder below said external screw thread of said container, said indicating portion having an initial position outside of the cylindrical surface of said skirt and a second position of said indicating portion inside of the cylindrical surface of said skirt, said indicating portion being movable radially of said skirt from said initial position to said second position, a tear zone of said device, a second shoulder on said indicating portion, whereby when said indicating portion is in the second position and when said second shoulder abuts said annular shoulder, axial movement of said skirt with respect to said container causes said indicating portion to separate from the skirt at said tear zone.

9. A closure device molded of resilient material, for use with a container having an external screw thread about an opening and a rim perpendicular to said thread, comprising: a circular crown disc, a cylindrical sidewall or skirt depending from said crown disc and perpendicular to it, an internal screw thread within said sidewall to mate with said external screw thread, and multiple sealing means integral with the inside surface of said crown disc for cooperation with the upper rim and adjacent inside rim of the opening of said container, said multiple sealing means comprising:

a first sealing means in the form of a circular ridge dependent from said crown disc and having a diameter substantially equal to the mean diameter of said upper rim;

a second sealing means in the form of an outwardly-flaring frusto-conical flexible flange supported by a concentric attachment to said crown disc and having an outer rim diameter substantially larger than the diameter of said first sealing means, said flange being engageable by said circular ridge to move said flange into intimate contact with a portion of said rim axially opposed to said ridge;

said first sealing means consisting of said circular ridge and a single circular groove directly adjacent to it, said ridge being asymmetrical and having its crest close to said groove, the volume of said groove above the adjacent lower surface of said crown disc being sufficient to accommodate the material of said ridge upon deflection of the ridge into said groove, and the volume of said ridge being so related to the resilience of said material that when subjected to a normal axial working load said ridge will be substantially or entirely defelected into said groove.

* * * * *